United States Patent [19]

Wood et al.

[11] Patent Number: 4,958,734

[45] Date of Patent: Sep. 25, 1990

[54] END LOADED CARTON HAVING A TRIPLE PLY WALL

[75] Inventors: Prentice J. Wood, Hapeville; Rodney K. Calvert, Dunwoody, both of Ga.

[73] Assignee: The Mead Corporation, Dayton, Ohio

[21] Appl. No.: 419,319

[22] Filed: Oct. 10, 1989

[51] Int. Cl.[5] ..... B65D 71/06

[52] U.S. Cl. ..... 206/435; 229/40; 229/122

[58] Field of Search ..... 206/140, 141, 427, 430, 206/435, 626, 628, 630; 229/40, 117.13, 122, 122.1, 183

[56] References Cited

U.S. PATENT DOCUMENTS

| | | | |
|---|---|---|---|
| 2,571,833 | 10/1951 | Chidsey, Jr. | 229/40 |
| 3,404,806 | 10/1968 | Richardson | 206/141 |
| 4,396,143 | 8/1983 | Killy | 206/427 |
| 4,582,199 | 4/1986 | Schuster | 206/427 |
| 4,588,084 | 5/1986 | Holley, Jr. | 206/427 |
| 4,653,686 | 3/1987 | Wood et al. | 206/427 |
| 4,784,316 | 11/1988 | Crouch | 206/427 |
| 4,785,991 | 11/1988 | Schuster | 206/427 |
| 4,836,375 | 6/1989 | Schuster | 206/427 |
| 4,895,296 | 1/1990 | Trauschke | 206/427 |

*Primary Examiner*—Jimmy G. Foster

*Attorney, Agent, or Firm*—Rodgers & Rodgers

[57] ABSTRACT

An end loaded carton for a plurality of cans includes foldably joined top, bottom and side walls forming a tubular structure and having end closure panels, one wall of the carton being of double ply construction having inner and outer panels, at least one thickening panel foldably joined to the inner ply and being folded into flat face contacting relation with the inner ply to form a three ply wall in engagement with the can ends.

5 Claims, 4 Drawing Sheets

END LOADED CARTON HAVING A TRIPLE PLY WALL

TECHNICAL FIELD

This invention relates generally to can cartons and more particularly to cartons for cans in an upper tier of cans whose bottom portions are recessed inwardly slightly so as to nest within the recessed tops of cans in a tier of cans immediately below the upper tier of cans.

BACKGROUND ART

U.S. Pat. No. 4,558,816 issued Dec. 17, 1985 and assigned to the assignee of this application discloses a can carton of the general type to which this invention is applicable.

SUMMARY OF THE INVENTION

Cans having slightly reduced bottom diameter portions tend to cause their bottom portions to nest within the slightly recessed top portions of cans in a lower tier of cans when such cans are disposed in cartons stacked in tiers one above another. This tendency of the cans to nest tends to weaken the top wall of a carton in lower tier and the bottom wall of a carton in an upper tier immediately above the lower tier.

According to this invention in one form, either the top or bottom wall of a carton is formed of a double ply thickness and a thickening panel is foldably joined to each end of the inner ply of the double wall and each such thickening panel is first folded out of the plane of the inner ply by machine elements and is then folded inwardly into flat face contacting relation with the inner ply due to engagement by incoming cans so as to form a triple thickness carton wall in instances where a carton is loaded from both ends. In instances where a carton is loaded from only one end, one thickening panel is foldably joined to an end edge of the inner ply of a wall panel and a second thickening panel is struck from the inner ply and foldably joined thereto, such thickening panels being initially folded out of the plane of the inner wall panel by machine elements and when engaged by cans loaded from one end of the carton and pushed into flat face contacting relation with the inner ply so as to prevent or alleviate damage which conceivably could be caused by a tendency of cans in an upper tier of cartons to nest within the cans of a lower tier of cartons disposed immediately below the upper tier of cans.

BEST MODE OF CARRYING OUT THE INVENTION

Figure 1:
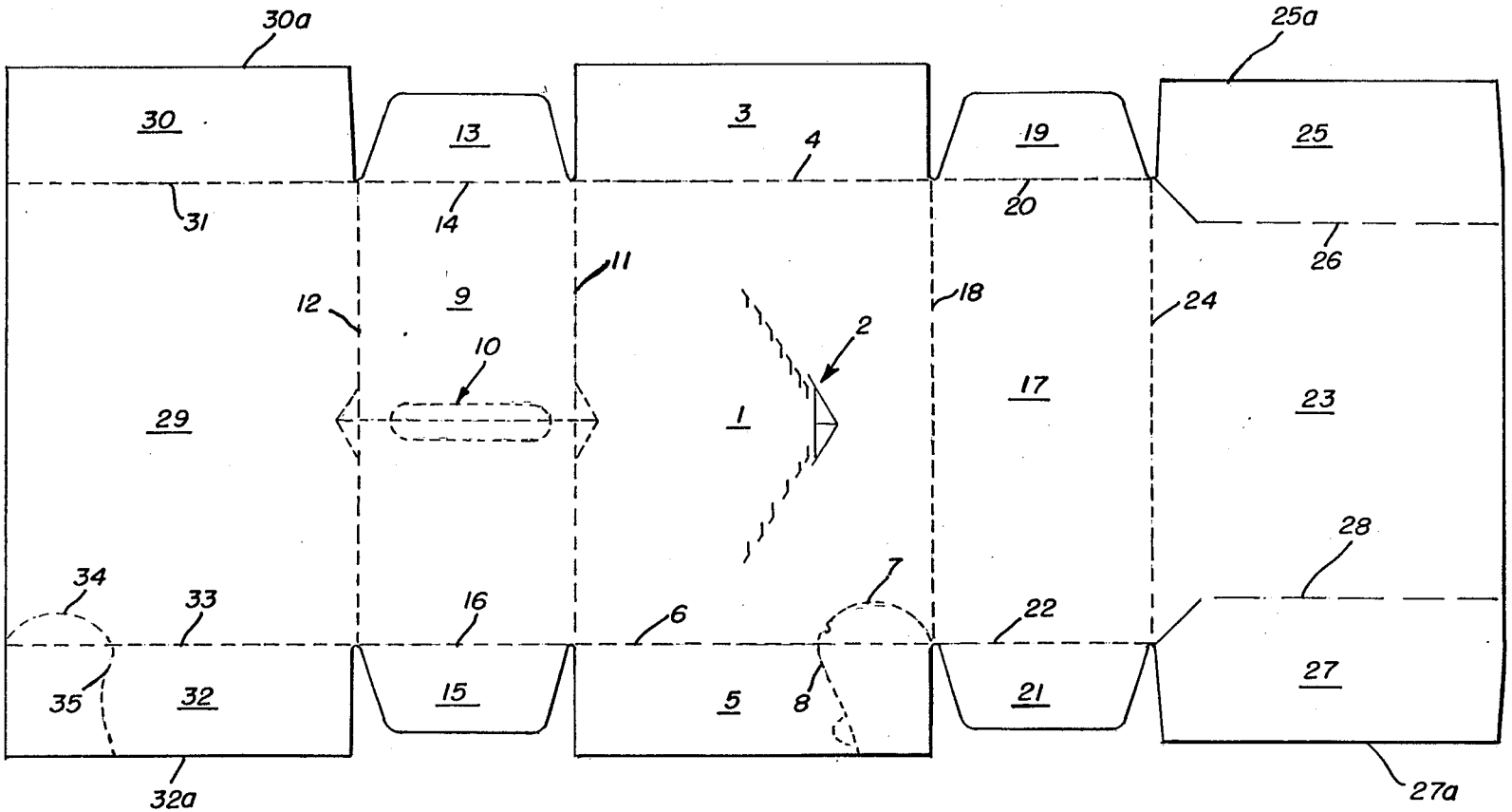
FIG. 1 is a plan view of a blank as viewed from the inside and from which a tubular carton is formed according to one form of this invention and which is loaded from both ends.

With reference to FIG. 1, the numeral 1 designates the top wall of the carton. Conventional severance structure generally designated by the numeral 2 is formed in top wall 1 to facilitate opening the carton to afford access to packaged cans. An end closure panel 3 is foldably joined along a fold line 4 to an end edge of top wall 1 and an end closure panel 5 is foldably joined along fold line 6 to the opposite end of top wall 1. A conventional severance line 7 is formed in top wall 1 and a cooperating severance line 8 is formed in end closure panel 5.

Side wall 9 includes handle structure generally designated by the numeral 10 and which is of the type disclosed in U.S. Pat. No. 4,558,816 issued Dec. 17, 1985 and owned by the assignee of this invention. Side wall 9 is foldably joined to top wall 1 along fold line 11 and to bottom wall outer ply 29 along fold line 12.

End closure panel 13 is foldably joined to side wall 9 along a fold line 14 and end closure panel 15 is foldably joined to side wall 9 along fold line 16.

Side wall 17 is foldably joined along fold line 18 to top wall 1. End closure panel 19 is foldably joined to side wall 17 along a fold line 20 and end closure panel 21 is foldably joined to side wall 17 along fold line 22.

The bottom of the carton includes inner ply 23 which is foldably joined to side wall 17 along fold line 24. Thickening panel 25 is foldably joined to the inner ply 23 of the bottom wall along transverse fold line 26. Thickening panel 27 is foldably joined along transverse fold line 28 to the inner ply 23 of the bottom wall of the carton.

The outer ply of the bottom wall of the carton is designated by the numeral 29. End closure panel 30 is foldably joined along fold line 31 to outer ply 29 of the bottom wall. End closure panel 32 is foldably joined to bottom wall outer ply 29 along fold line 33. A weakened severance line of known construction is formed in outer ply 29 and is designated at 34. A cooperating weakened line 35 is formed in end closure panel 32.

Figure 2:
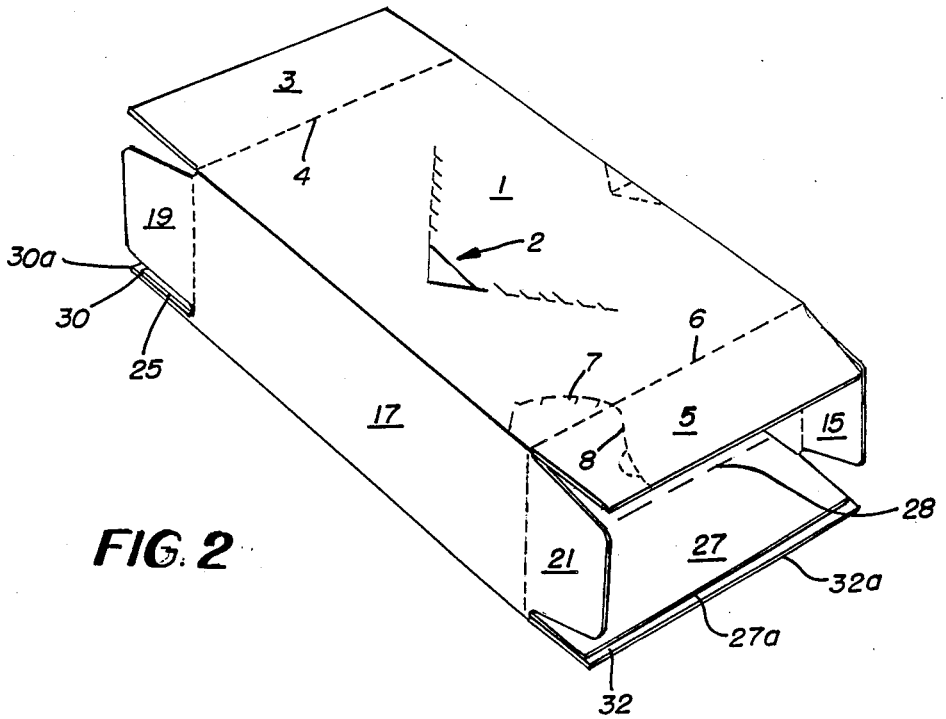
FIG. 2 is a perspective view of a carton formed from the blank shown in FIG. 1.
Figure 3:
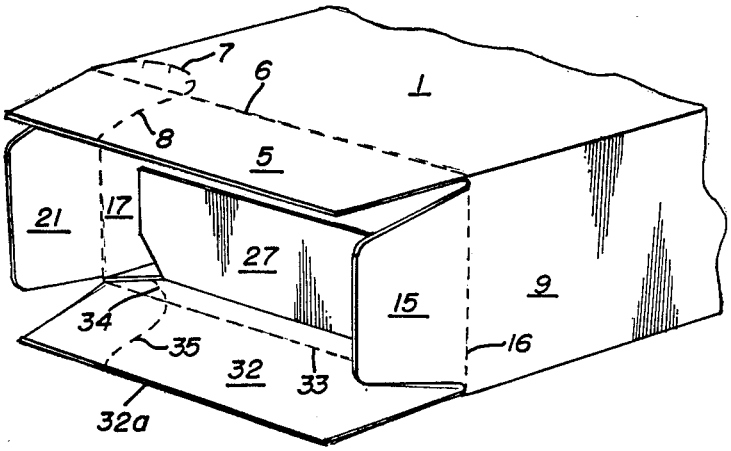
FIGS. 3 and 4 show folding stages of a thickening panel foldably joined to an end of the inner ply of a carton wall.
Figure 4:
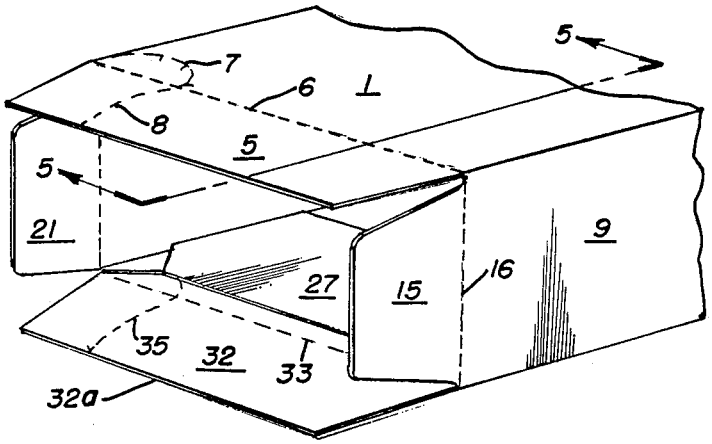

In order to form the blank of FIG. 1 into tubular form as shown for example in FIGS. 2, 3 and 4, an application of glue is made to the outer surface of inner ply 23 of the bottom wall and inner ply 23 together with side wall 17 are elevated and folded upwardly and to the left along fold line 18 and outer ply 29 of the bottom wall is folded upwardly and to the right along fold line 12 and into flat face contacting relation with the inner ply 23 of the bottom wall. With the inner and outer plys of the bottom wall secured in flat face contacting relation to each other, the carton may then be set up as shown for example in FIGS. 2, 3 and 4.

From FIG. 2 it is apparent that the outer edge 32*a* of end closure panel 32 extends outwardly a slight distance beyond the outer edge 27*a* of thickening panel 27. Similarly, the outer edge 30*a* of end closure panel 30 projects outwardly a slight distance beyond the end edge 25*a* of end closure panel 25.

Figure 5:
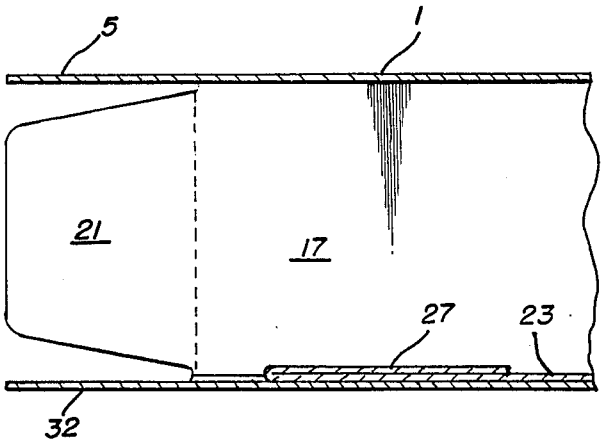
FIG. 5 is a fragmentary cross sectional view taken along the line designated 5—5 in FIG. 4.

When the carton is in the position shown in FIG. 2 for example and is being moved in a direction generally from left to right or vice versa, machine static plows engage the outer end edges 32*a* and 30*a* of end closure panels 32 and 30 and move those panels downwardly somewhat and initiate upward folding of thickening panels 25 and 37. Thereafter insertion of cans from both ends of the carton causes the thickening panels 25 and 27 to swing upwardly and inwardly along their transverse fold lines 26 and 28 due to engagement with the incoming cans respectively and into flat face contacting relation with the inner ply 23 of the bottom wall. These thickening panels then occupy the positions as indicated in connection with thickening panel 27 in FIGS. 4 and 5.

Figure 6:
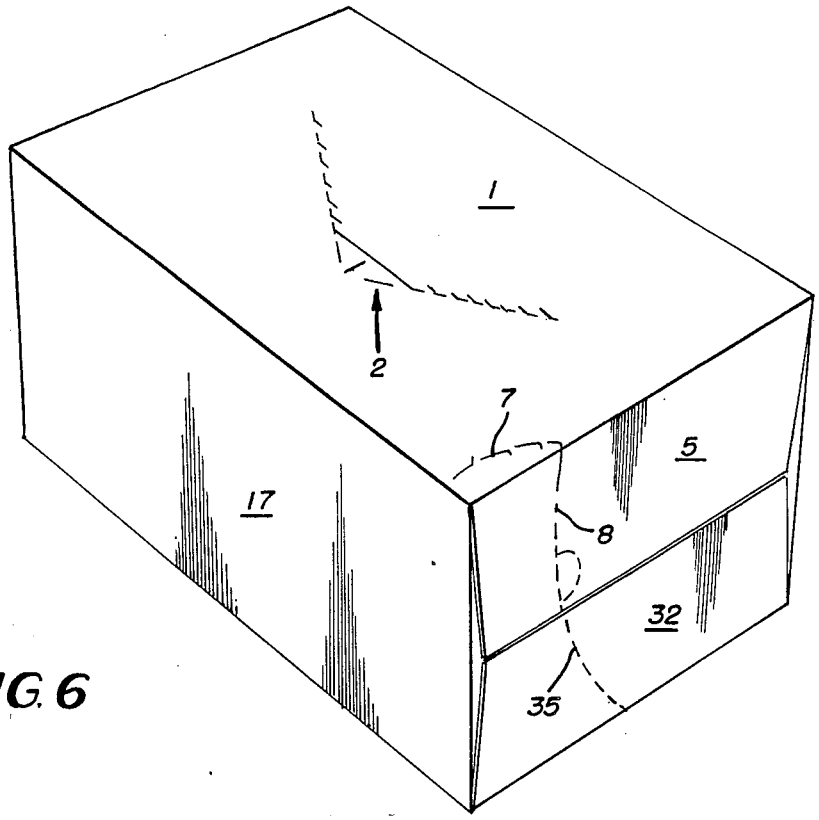
FIG. 6 is a perspective view of a fully loaded and set up carton formed according to this invention.

With the carton fully loaded with cans, end closure panels 30, 13, 3, 19 and 25 at one end of the carton together with end closure panels 32, 15, 5, 21 and 27 at the other end of the carton are folded inwardly and appropriately glued as is well known so that the fully loaded and set up closed carton appears as shown in FIG. 6. Of course the bottoms of the cans which rest at least in part on the thickening panels 25 and 27 are inhibited from nesting within the upper recesses of cans in the tier of cans below.

Figure 7:
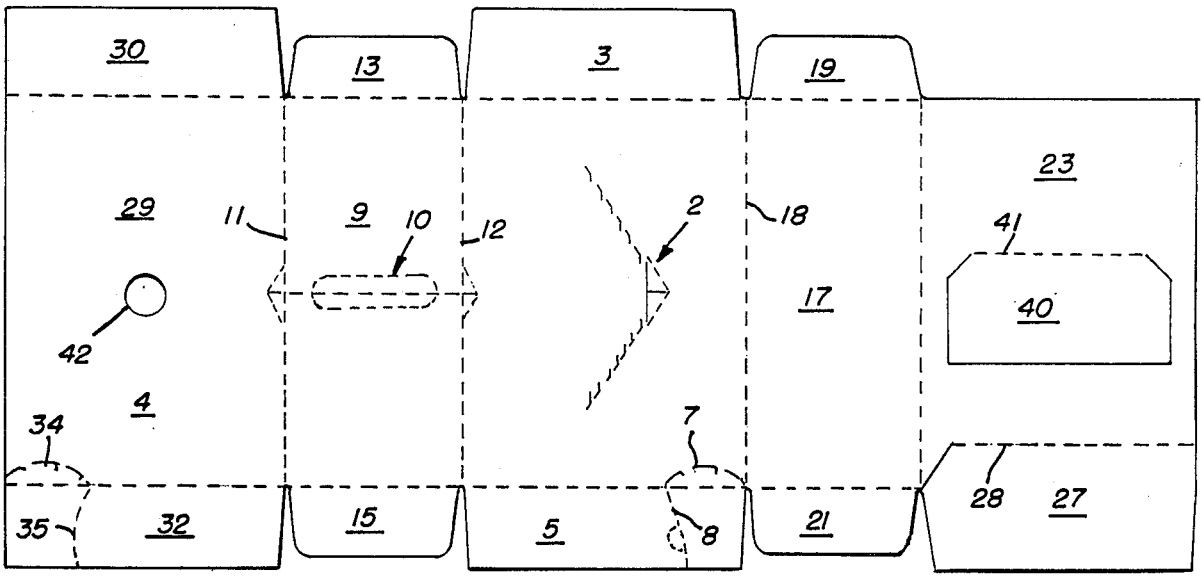
FIG. 7 is a plan view of a blank similar to FIG. 1 as shown from the inside for use in connection with cartons that are loaded from one end only.

The invention is also applicable to cartons which are loaded from one end only. In this connection, the blank shown in FIG. 7 is virtually identical to that shown in FIG. 1 except that in addition to the thickening panel 27, a thickening panel 40 is struck from the inner ply 23 of the bottom wall and is foldably joined to that ply along a fold line 41. In connection with this modification of the invention, the thickening panel 27 is manipulated as described in connection with the double loading carton of FIGS. 1–7 inclusive. The additional panel 40 is also folded over into flat face contacting relation by the incoming cans after the thickening panel 40 is swung somewhat out of the plane of the inner ply 23. In order to swing this thickening panel out of the plane of inner panel 23, an aperture 42 is formed in the outer ply 29 of the bottom wall to allow access of a machine plunger not shown which moves upwardly from below the carton and through aperture 42 and into engagement with the thickening panel 40. With the thickening panel 40 thus moved out of the plane of inner ply 23, the incoming cans having swung thickening panel 27 into flat face contacting relation with inner ply 23, then engage the thickening panel 40 and swing that panel into flat face contacting relation with the inner surface of inner ply 23 and thus function in a manner similar to the functioning of the thickening panels 25 and 27 shown in FIG. 1.

For some applications of the invention, it may be desirable to strike a panel such as 40 from an inner ply such as 23 having a fold line such as 41 without having a thickening panel foldably joined to an end edge 26 of inner wall ply 23.

Figure 8:
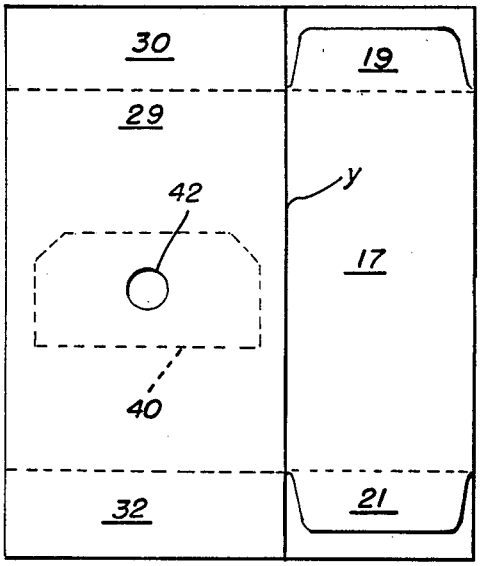
FIG. 8 is a view of the blank shown in FIG. 7 after the blank is manipulated into a condition wherein its top, bottom and side walls are formed into a tubular structure and as shown from below.

FIG. 8 simply shows the blank of FIG. 7 with walls 23 and 17 folded to the left along fold line 18 and with wall ply 29 folded over into contact with bottom ply 23 with the blank in collapsed form following the gluing of inner ply 23 in flat face contacting relation with the outer ply 29 of the bottom wall and which also shows the aperture 42 in alignment with the thickening panel 40 which thus appears in dotted lines. The collapsed and glued blank of FIG. 8 is shown upside down from the position of the carton when the carton is in tubular form and ready for loading as shown in FIG. 2.

While the bottom wall of the carton is shown and described as being of double ply construction and having the thickening panels foldably joined thereto, it is obvious that the top wall could be formed of double ply construction with the thickening panels foldably joined thereto since either of these arrangement would effectively inhibit can nesting and possible damage to the carton.

We claim:

1. An end loaded carton for packaging a plurality of cans arranged in side by side relation, said carton comprising foldably joined top, bottom and side walls forming a tubular structure and having end closure panels, one wall of the carton being of double ply construction having inner and outer panels and being in engagement with the ends of the packaged cans, the inner ply of said one wall including a thickening panel foldably joined to an end edge of said inner ply which is spaced inwardly from the adjacent end edge of said outer ply, said thickening panel being folded into flat face contacting relation with said inner ply to form a three ply wall in engagement with the can ends.

2. An end loaded carton for packaging a plurality of cans arranged in side by side relation, said carton comprising foldably joined top, bottom and side walls forming a tubular structure and having end closure panels, one wall of the carton being of double ply construction having inner and outer panels and being in engagement with the ends of the packaged cans, the inner ply of said one wall including a thickening panel foldably joined to said inner ply along a transverse fold line, said thickening panel being initially folded out of the plane of said inner ply and thereafter folded into flat face contacting relation with said inner ply due to engagement with incoming cans during loading of the carton through an end thereof to form a three ply wall in engagement with the can ends.

3. An end loaded carton for packaging a plurality of cans arranged in side by side relation, said carton comprising foldably joined top, bottom and side walls forming a tubular structure and having end closure panels, one wall of the carton being of double ply construction having inner and outer panels and being in engagement with the ends of the packaged cans, the inner ply of said one wall including a thickening panel foldably joined to each end of said inner ply and initially folded out of the plane of said inner ply and thereafter respectively folded into flat face contacting relation with said inner ply due to engagement by cans while the cans are being loaded from each end of the carton to form a three ply wall in engagement with the can ends.

4. An end loaded carton for packaging a plurality of cans arranged in side by side relation, said carton comprising foldably joined top, bottom and side walls forming a tubular structure and having end closure panels, one wall of the carton being of double ply construction having inner and outer panels and being in engagement with the ends of the packaged cans, and a pair of thickening panels foldably joined to said inner ply along transverse spaced apart fold lines and being folded into flat face contacting relation with said inner ply to form a three ply wall in engagement with the can ends.

5. An end loaded carton according to claim 4 wherein said thickening panels are initially folded out of the plane of said inner ply and are thereafter engaged in sequence by cans loaded through one end only of said carton and folded into flat face contacting relation with said inner ply.

* * * * *